US008708053B2

(12) United States Patent
Pollack et al.

(10) Patent No.: US 8,708,053 B2
(45) Date of Patent: Apr. 29, 2014

(54) RISER INSTALLATION FROM OFFSHORE FLOATING PRODUCTION UNIT

(75) Inventors: Jack Pollack, Houston, TX (US); David Riggs, Coppell, TX (US); Feng Guo, Spring, TX (US)

(73) Assignee: Single Buoy Moorings, Inc., Marly (CH)

( * ) Notice: Subject to any disclaimer, the term of this patent is extended or adjusted under 35 U.S.C. 154(b) by 1888 days.

(21) Appl. No.: 11/352,595

(22) Filed: Feb. 13, 2006

(65) Prior Publication Data

US 2006/0201564 A1 Sep. 14, 2006

Related U.S. Application Data

(60) Provisional application No. 60/662,281, filed on Mar. 16, 2005, provisional application No. 60/661,358, filed on Mar. 14, 2005.

(51) Int. Cl.
*E21B 17/01* (2006.01)

(52) U.S. Cl.
USPC ..... 166/353; 166/367; 405/169; 405/224.2

(58) Field of Classification Search
USPC ..... 166/338, 341, 343, 351–355, 367, 381; 405/224.2–224.4
See application file for complete search history.

(56) References Cited

U.S. PATENT DOCUMENTS 3,352,356 A * 11/1967 Wakefield, Jr. ..... 166/352
3,373,807 A * 3/1968 Fischer et al. ..... 166/342
3,690,112 A * 9/1972 Pattison et al. ..... 405/169
3,846,992 A * 11/1974 Liautaud ..... 405/169
4,133,182 A * 1/1979 Chateau ..... 405/169
4,266,886 A * 5/1981 Milton ..... 405/169
4,277,202 A * 7/1981 Archambaud et al. ..... 405/169
4,455,040 A * 6/1984 Shinn ..... 285/123.12
4,588,326 A * 5/1986 Langner ..... 405/169
4,643,614 A * 2/1987 Laursen ..... 405/169
4,704,050 A * 11/1987 Wallace ..... 405/224.2
4,784,523 A * 11/1988 Louis et al. ..... 405/169
4,793,737 A * 12/1988 Shotbolt ..... 405/169
4,810,133 A * 3/1989 Kopp et al. ..... 405/168.1
5,582,252 A * 12/1996 Richmond et al. ..... 166/352
5,702,205 A * 12/1997 Mahone et al. ..... 405/169

(Continued)

FOREIGN PATENT DOCUMENTS

WO WO 2004//035375 A1 4/2004
WO WO 2004/035375 A1 * 4/2004

*Primary Examiner* — Matthew Buck
(74) *Attorney, Agent, or Firm* — Timothy T. Tyson; Lawrence S. Cohen

(57) ABSTRACT

A method for installing risers so they extend from a FPU (floating production unit) to multiple subsea hydrocarbon wells of an oil field, which avoids damage to the pipe sections and that is economical. As pipe sections are connected to a near end (56) of a pipe string portion (68B-68D) that lies at the FPU, a tug boat (30) pulls the far end (65) of the pipe string toward a well head. Initially, a long pull line (34) extends from a winch (32) on the tug boat, in a double catenary curve to the far end of the pipe string. The winch is operated to shorten the pull line until the pipe string extends in a double catenary curve (60). Tension in the pipe string is maintained at a proper level during installation by maintaining the near end portion of the pipe string so it extends at a near end angle (70) to the vertical that continually lies within a predetermined range, such as from 3° to 12°.

3 Claims, 3 Drawing Sheets

(56) References Cited

U.S. PATENT DOCUMENTS

| | | | | |
|---|---|---|---|---|
| 6,062,769 | A * | 5/2000 | Cunningham | 405/195.1 |
| 6,394,154 | B1 | 5/2002 | Pollack | |
| 6,601,656 | B2 * | 8/2003 | Hopper et al. | 175/5 |
| 7,600,569 | B2 * | 10/2009 | Routeau et al. | 166/344 |
| 7,744,312 | B2 * | 6/2010 | Pollack et al. | 405/170 |
| 8,142,108 | B2 * | 3/2012 | Pollack et al. | 405/169 |
| 2002/0048492 | A1 * | 4/2002 | Thomas | 405/224.2 |
| 2002/0116123 | A1 * | 8/2002 | Lampe et al. | 701/213 |

* cited by examiner

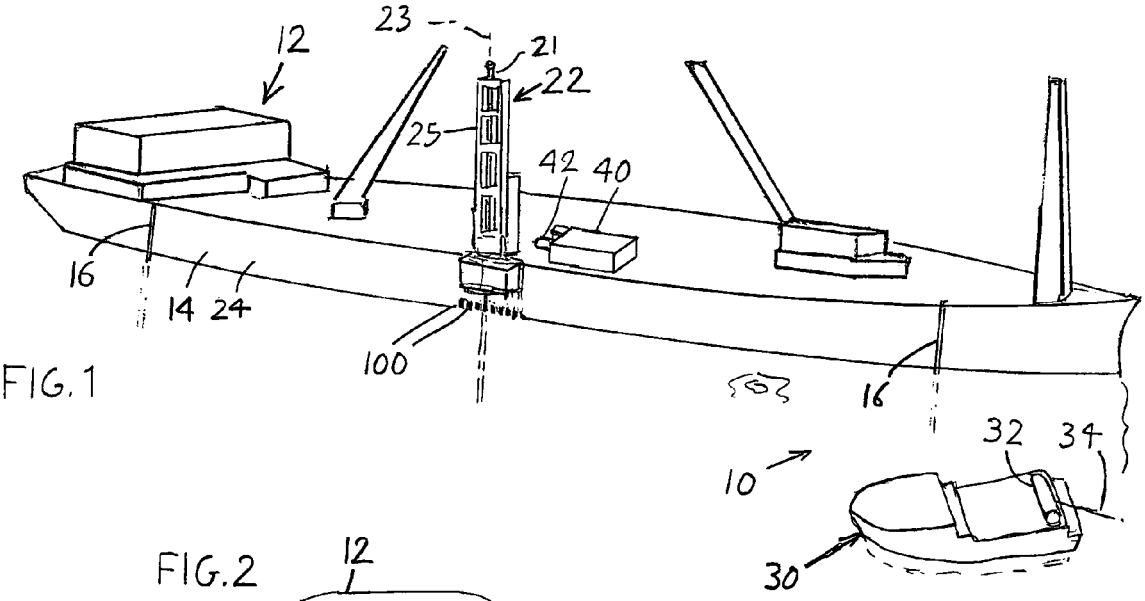
FIG. 1
FIG. 2
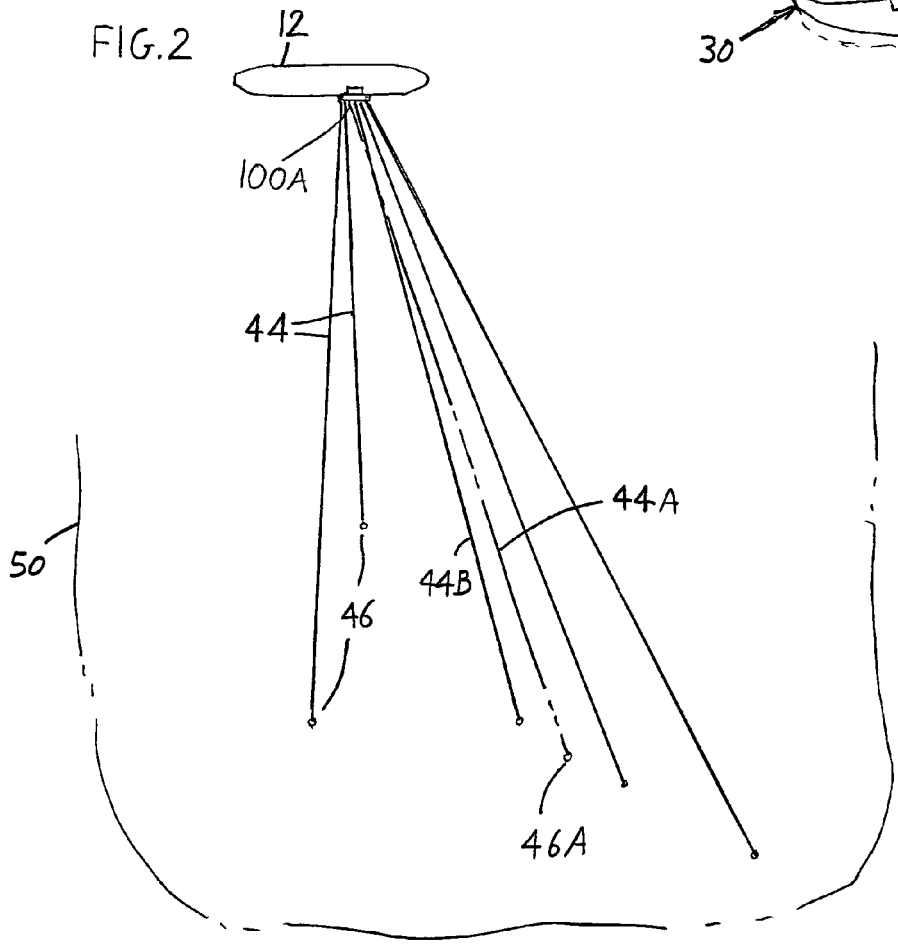

RISER INSTALLATION FROM OFFSHORE FLOATING PRODUCTION UNIT

BACKGROUND OF THE INVENTION

Hydrocarbons from a deepwater field (in a sea of at least 100 meters depth) can be produced by the use of a FPU (floating production unit) that carries equipment for removing sand, stones, water, etc. from hydrocarbons that are produced from subsea wells, storing the hydrocarbons, and offloading the stored hydrocarbons to a tanker at intervals. As a field is developed, risers are laid on the sea floor to connect the FPU to additional wells. A large field may be developed over a period of years, as the drilling and completion of wells progresses. Construction vessels that have been used to lay down steel pipe in a pipe string that extends from a well to the FPU, are large and costly, with working rates that may exceed $200,000 per day. A lower cost way to install a pipe string between the FPU and each of a plurality of seafloor well heads over a long period of time, would be of value.

SUMMARY OF THE INVENTION

In accordance with one embodiment of the invention, a method and apparatus are provided for installing risers in the form of pipe strings that extend between a FPU (floating production unit) and sea floor well heads, in an economical manner. The method includes connecting pipe sections at the FPU and lowering them with their axes initially extending primarily vertically, into the sea to create a pipe string composed of the pipe sections. While pipe sections are added at a near end of the pipe string that lies at the FPU, the far end of the pipe string which is opposite the near end, is pulled by a tug boat toward the well head to which the pipe string is to be connected. The far end of the pipe string is attached to a tug line that extends to the tug boat. The tug line initially is long and extends in a double catenary curve, and is pulled in by a tug winch to pull the far end of the pipe string until the pipe string extends in a double catenary curve. The tug boat moves forward to continue to pull the far end of the pipe string, with pipe string bending controlled by maintaining the near end of the pipe string at an angle to the vertical which is within a limited range such as between 6° and 12°.

When a portion of the pipe string rests on the sea floor, the tug boat continues to pull the far end of the pipe string while the pipe string slides along the sea floor. The near end angle of the pipe string is maintained within the limited range by moving the tug boat in steps every time a number of new pipe sections is added to the near end of the pipe string. When the far end of the pipe string lies close to the intended well head, the FPU lowers the near end of the pipe string so it lies deep under water. The tug pulls the far end of the pipe string and lowers it to connect it to the well head. The FPU then lifts the near end of the pipe string up to the FPU. This results in the near end angle increasing as from the range of 3°-12° to 20°, which results in greater pipe string tension in the fully installed pipe string.

The novel features of the invention are set forth with particularity in the appended claims. The invention will be best understood from the following description when read in conjunction with the accompanying drawings.

BRIEF DESCRIPTION OF THE DRAWINGS

FIG. 1 is an isometric view of a production system of the invention, showing a FPU (floating production unit) and the near end of a pipe string, and showing a tug boat.

FIG. 2 is a plan view of the production system of FIG. 1.

DESCRIPTION OF THE PREFERRED EMBODIMENTS

Figure 3:
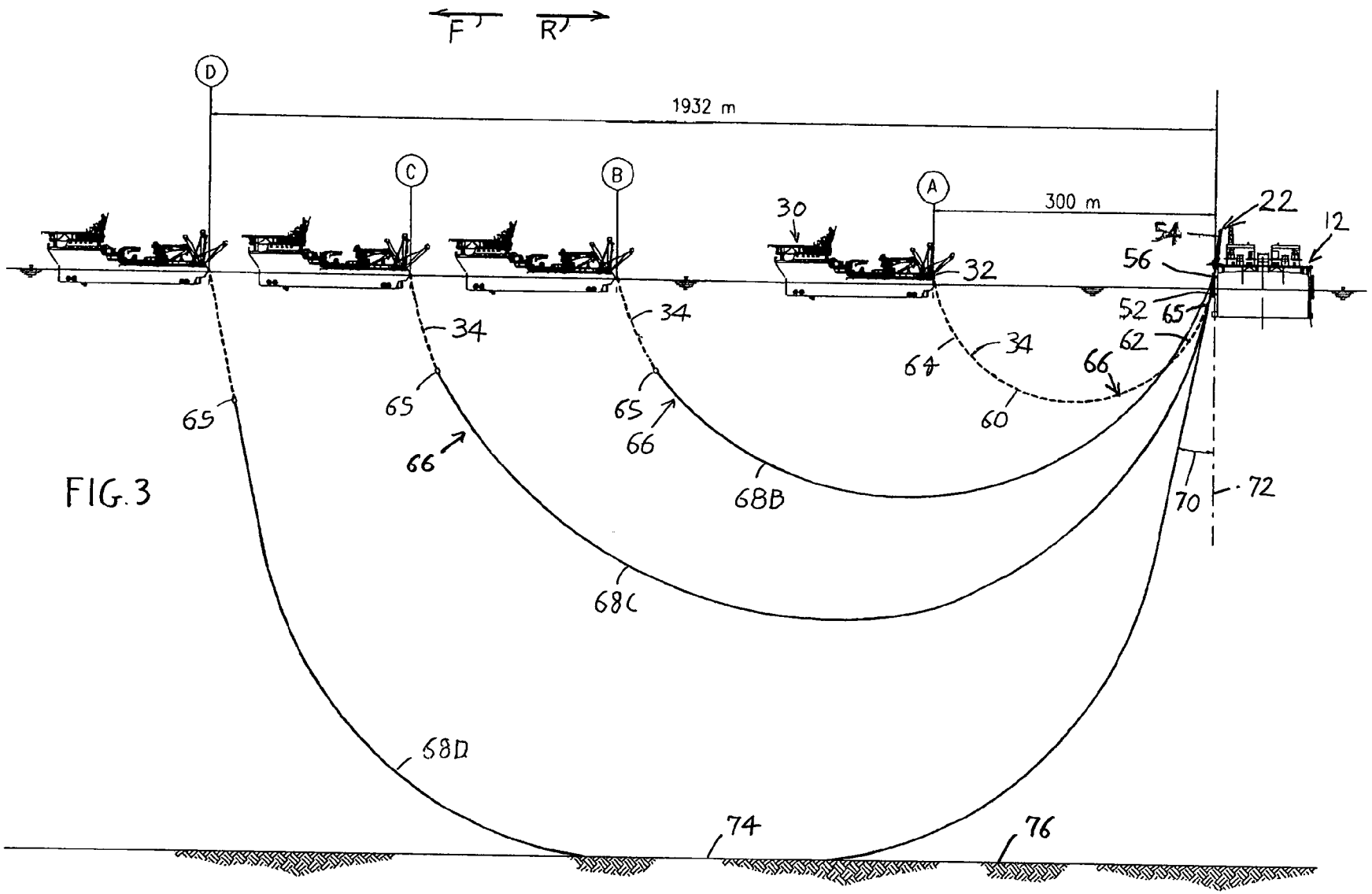
FIG. 3 is a side elevation view of the production system of FIG. 1, showing the tug boat and pipe string at four different position during the installation of the pipe string.

FIG. 1 illustrates a hydrocarbon production system 10 which includes a FPU (floating production unit) 12 that has a vessel hull 14 that is anchored to the sea floor as by mooring though multiple mooring lines 16. A J-lay tower 22 is mounted on the hull, at one side 24, with the J-lay tower extending beyond the hull side. The J-lay tower includes a winch 25 that is designed to hold a long pipe section 21, with the axis 23 of each pipe section being primarily vertical as its lower end is connected to the upper end of the last pipe section. The following description of the installation of a pipe string assumes the use of steel pipes of 10 inch diameter that come in lengths of 24 or 37 meters. A string of pipe sections may have a total length of 1000 meters or more, so a large number of pipe sections will be connected in series to create a pipe string that is commonly referred to as a riser after it is installed.

FIG. 1 shows a tug boat 30 which applicant uses to pull out the pipe string to install it. The tug boat, or tug, is a dynamically positioned boat with a GPS (global positioning system) unit, so it can maintained itself at a desired position and can be moved in any direction on the sea surface. The tug boat has a motor-powered winch 32 that allows it to pay out and pull in a tug line 34, such as a steel cable. The PDU has hydrocarbon processing facilities 40 as to remove sand and water from hydrocarbons, with ports 42 for receiving hydrocarbons from installed pipe strings, or risers. FIG. 2 shows that the FPU may be connected to a large number of pipe strings, or risers 44 that each extends to a different well head 46 that connects to a well in a sub sea reservoir 50.

FIG. 3 shows four different stages in the installation of a riser. In a first stage, the rear of the tug is at position A, and a first pipe section 52 has been lowered from the J-lay tower 22 while a connection is being made to the next pipe section 54. The upper end of the first pipe section is considered to be the near end 56 of the pipe string (now consisting of a single pipe). The tug line 34 extending rearwardly R from the tug, extends in a double catenary curve 60 (portion 62 extends at a forward-downward incline and portion 64 extends at a forward-upward incline) to the lower end of the first pipe section 52. The rear end of the tug line is attached by a connector 65 to the front or far end of the pipe string. As additional pipe sections are attached in tandem to the first one, the tug operates its winch 32 to pull in the tug line so the pipe string extends along progressively greater percentages of the combination 66 of pipe string and deployed length of pull line, until the pipe string portion at 68B extends in a double catenary curve as at tug position B. Each portion of the pipe string can be referred to as a pipe string because it includes a string of pipes, or as a pipe string portion because it is a portion of the final, longer pipe string, or riser.

During the lengthening of the pipe string by attaching additional pipe sections, applicant controls the orientation of the pipe string portion extending down from the FPU by closely monitoring the deployment angle, or near end angle 70 of the pipe string. Applicant maintains the angle 70 within a predetermined range between about 3° and 12° (2° to 15°) from a vertical line 72. The near end angle 70 can be measured as the angle of the pipe string under the FPO or the average angle of the top two pipe sections that lie below the J-lay tower, or the angle at a depth of 50 meters below the sea surface and close to the FPU.

When the tug pull line 34 has been sufficiently shortened at tug position B and pipe sections are added, the tug is moved forward in steps and maintained in a stationary position between those steps. By now, at tug position B, the connection 65 that lies at the rear of the tug pull line, lies along a forward-upward incline. When sufficient pipe sections have been added that the near end angle 70 has decreased to the lower end of the range such as 3°, the tug is moved forward F until the near end angle has increased as to 10° to 12°. The tug is then held in position while additional pipe sections are added and the angle decreases to 6°, when the tug is advanced again. FIG. 3 shows the tug at positions B and C with the tug line 34 at a constant length, and with the pipe string portion at 68B and 68C being of progressively greater lengths as additional pipe sections have been added. If the final riser is long enough compared with the depth of the sea, then the tug will reach the position D at which the pipe string portion 68D has a part 74 that rests on the sea floor 76. The tug continues to move forward in steps while pipe sections are added, with the middle pipe string part 74 sliding along the sea floor. The sea floor has been surveyed to make sure that the pipe string part on the sea floor will not be damaged.

In one installation method that applicant has designed for a 10 inch steel pipe, the tug initially lies at position A (FIG. 3) which is 300 meters forward of the FPU 12, with a 750 meter length of tug line 34 extending to the FPU. The pipe string lengthens as pipe sections are added, and the tug pulls in its pull line, and then moves forward in steps with pipe sections added between steps. A tug pull line length of a plurality of hundreds of meters will be required in most systems.

Figure 4:
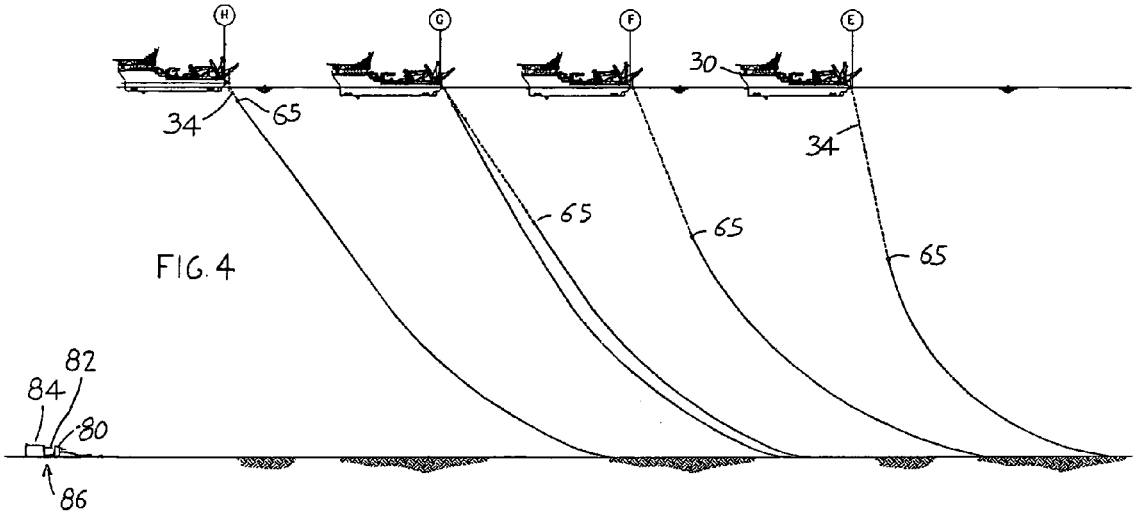
FIG. 4 is a side elevation view of the production system of FIG. 3, shown at four later positions during the installation of a pipe string.

FIG. 4 shows the tug as it moves progressively more forward through positions E, F and G until it reaches a position H. Then, the winch on the tug is operated to pull in its tug pull line 34 so the connector 65 lies at only a small depth. A pipeline end termination 80 is attached to the far end of the pipe string, and the pipe string is lowered to the sea floor to connect to a connection 82 of a well head platform 84 of a well head 86 at the sea floor that has been previously installed. A remotely operated vehicle is usually used to accompany the pipeline end termination down to the well head and to help make the connection.

Figure 5:
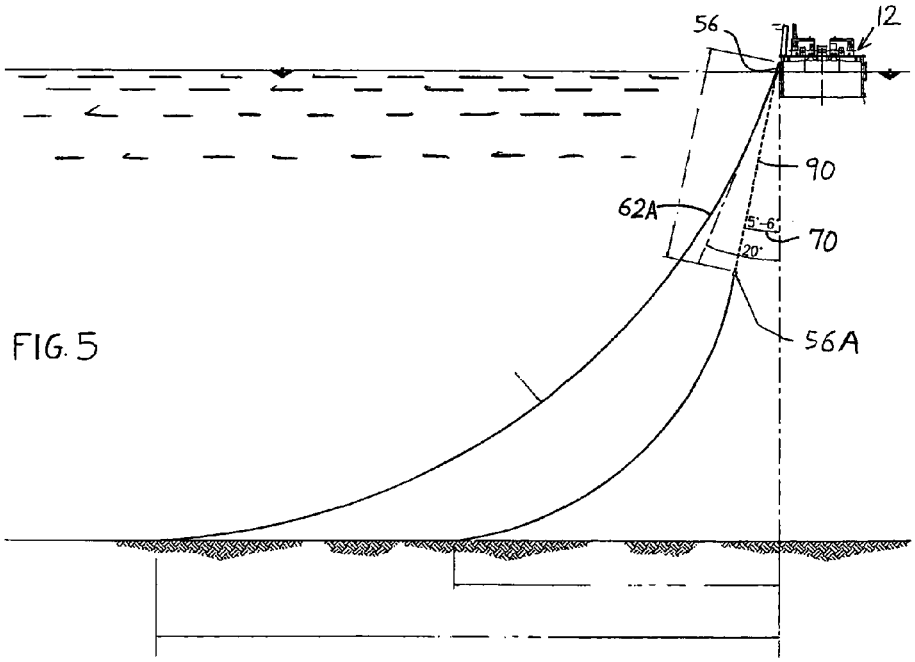
FIG. 5 is a side elevation view of the FPU of FIG. 3 during final stages in the installation of the pipe string.

Before the far end of the pipe string, which is held by the tug is pulled to the position at G or H, activity takes place at the near end 56 (FIG. 5) of the pipe string, at the FPU (floating production unit) 12. FIG. 5 shows that applicant attaches a line 90 to a winching device such as a winch of the J-lay tower or a separate winch, and to the near end 56 of the pipe string, and operates the winching device to lower the near end of the pipe string a plurality of meters (a depth of more than 10 meters) below the FPU to position 56A. After the far end of the pipe string has been pulled further forward, applicant operates the winch device to raise the pipe string near end 56A to the deck of the FPU and connects the pipe string near end to the hydrocarbon-receiving port 42 (FIG. 1). The raising of the near end of the pipe string so the near end portion lies at 62A, increases the near end angle 70 (FIG. 5) from about 6° to about 20° (15° to 28°). With the near end portion at 62A of the pipe string which is now serving as a portion of the riser, extending at such a large angle, tension in the riser near end part 62A greatly increases. This higher tension avoids buckling of the near end part 62A of the riser from compression in the event of storms that produce large waves.

FIG. 1 shows that the FPU has many ducts that each form connectors 100 that each connects a pipe string in its primarily downward extension into the sea. A separate connection is used for each pipe string, or riser to prevent risers from rubbing against each other. Once in a while, it is desired to extend a pipe string 44A (FIG. 2) to a well head such as 46A where the only guide available 100A is positioned so any pipe string extending from guide 100A must cross another riser 44B (as seen in the plan view of FIG. 2). This can be done in the normal way, with the tug pulling the new pipe string 44A under the existing riser 44B that it must cross. The near end of the new pipe string 44A is maintained at a near end angle of 3° to 12° during installation. At the end of installation, the near end portion of the new riser is pulled to a connector 100 that avoids riser crossings and the riser extends at the same near end angle such as 20° from the vertical as the other risers it crosses.

Thus, the invention provides a method and apparatus for economically installing risers in extension between a FPU (floating production unit) and well heads. The method includes using a tug boat (any vessel that can pull is considered a tug boat) to pull a pipe string (that will become a riser when installed) as the pipe string is lengthened by connecting additional pipe sections to the near end of the pipe string. Bending of the pipe string is controlled by pulling the far end of the pipe string so the near end extends at a near end angle to the vertical where the angle is maintained within a predetermined range that is preferably between 3° and 15°. The tug initially extends a tug line rearwardly long enough so it extends in a double catenary curve to the far end of the short pipe string. The tug maintains a constant position and the tug line is pulled forward into the tug while the pipe string lengthens, until the pipe string extends in a double catenary curve and preferably extends along most of the distance along the forward portion of the double catenary curve. Thereafter, the tug moves forward in steps and stops between steps, and additional pipe sections are added while the tug is stopped. Movement of the tug and adding of pipe sections is controlled so the near end angle of the pipe string remains within the predetermined range. Finally, the near end of the pipe string is lowered into the sea below the FPU, the far end is pulled, and the near end is raised, to increase the near end angle.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for installing a riser to extend between a FPU (floating production unit) and a well head lying at the sea floor, by connecting lengths of pipe sections in series while holding them primarily vertically at a side of said FPU and lowering the pipe sections into the sea, to create a pipe string which has a near end at said FPU and an opposite far end which is repeatedly lengthened, and when the far end of the pipe string portion lies in the vicinity of one of said well heads lowering said far end and connecting it to the well head, wherein said step of lengthening includes coupling said far end of said pipe string to a tug line on a tug boat and operating said tug boat to pull said far end forwardly away from said FPU while said pipe string portion extends from said FPU to said tug line of said tug boat, wherein:

said step of lengthening includes initially positioning the tug boat at a tug position (A) close to the PDU and extending a long enough length of said tug line from a winch on said tug boat to the far end of the pipe string while said pipe string includes at least one pipe section, so the tug line extends from the tug boat in a double catenary curve to the pipe string, and operating said winch to pull the tug pull line to shorten it until the tug line extends in a single catenary curve from the far end of the pipe string to the tug boat and the pipe string extends in a double catenary curve;

repeatedly moving the tug boat to positions (B, C) progressively further away from said FPU, to move the pipe string far end closer to the well head.

2. A method for installing a riser to extend between a FPU (floating production unit) and a well head lying at the sea floor, by connecting lengths of pipe sections in series while holding them primarily vertically at a side of said FPU and lowering the pipe sections into the sea, to create a pipe string which has a near end at said FPU and an opposite far end and which is repeatedly lengthened, and when the far end of the pipe string lies in the vicinity of one of said well heads lowering said far end and connecting it to said one of said well heads, wherein said step of lengthening includes coupling said far end of said pipe string to a tug line on a tug boat and operating said tug boat to pull said far end forwardly away from said FPU while said pipe string extends from said FPU to said tug line of said tug boat, wherein:

said step of lengthening includes moving said tug boat forwardly in steps and then maintaining the tug boat at a constant geographic location, and includes performing said step of connecting lengths of pipe sections in series while monitoring the angle (70) from the vertical of near pipe end portion, while the tug boat is maintained at the constant geographic location.

3. A method for installing a riser to extend between a FPU (floating production unit) and a well head lying at the sea floor, by connecting lengths of pipe sections in series while holding them primarily vertically at a side of said FPU and lowering the pipe sections into the sea, to create a pipe string which has a near end at said FPU and an opposite far end and which is repeatedly lengthened, and when the far end of the pipe string lies in the vicinity of one of said well heads lowering said far end and connecting it to said one of said well heads, wherein said step of lengthening includes coupling said far end of said pipe string to a tug line on a tug boat and operating said tug boat to pull said far end forwardly away from said FPU while said pipe string extends in a catenary curve from said FPU to said tug line of said tug boat, wherein:

said step of operating said tug boat to pull said pipe string far end includes moving said tug boat to pull said far end of the pipe string away from the FPU, with most movement of the pipe string far end produced by tug boat movement rather than by shortening the length of the tug line.

* * * * *